United States Patent [19]

Kaucic et al.

[11] 4,159,159

[45] Jun. 26, 1979

[54] TERMINAL MODULE WITH DUAL BINDING POST TERMINALS

[75] Inventors: Edward M. Kaucic, Milwaukee; Christopher J. Salimes, Lake Geneva; Bradley J. Smith, Milwaukee; Michael J. Cherveny, Cedarburg; Harley J. Van de Loo; Hans J. Ziegler, both of Milwaukee, all of Wis.

[73] Assignee: Utility Products Co., Inc., Milwaukee, Wis.

[21] Appl. No.: 918,361

[22] Filed: Jun. 23, 1978

[51] Int. Cl.[2] ..... H01R 9/10

[52] U.S. Cl. ..... 339/198 H; 339/249 A; 339/270 R

[58] Field of Search ..... 339/198, 246, 249 A, 339/270, 263

[56] References Cited

U.S. PATENT DOCUMENTS

| | | | |
|---|---|---|---|
| 2,735,994 | 2/1956 | Obszarny | 339/198 R |
| 2,906,990 | 9/1969 | Cain et al. | 339/270 R |

*Primary Examiner*—Joseph H. McGlynn

*Attorney, Agent, or Firm*—Quarles & Brady

[57] ABSTRACT

A modular terminal for fast and secure installation of a wire pair insuring electrical isolation of each wire in utility interface equipment requiring a large number of such installing operations is supported by a boss of insulating material. A pair of continuous contact pins are each formed with two-pronged wire clamps having a wire-receiving slot between the prongs. The contact pins extend into the housing in spaced apart positions with the lower prongs seated on the boss and the wire-receiving slots for the pair opening in the same direction. A cap is seated on the upper prongs of the wire clamps and is fastened to the boss with a terminal screw that is advanced to simultaneously secure a pair of conductors held in the wire-receiving slots.

14 Claims, 8 Drawing Figures

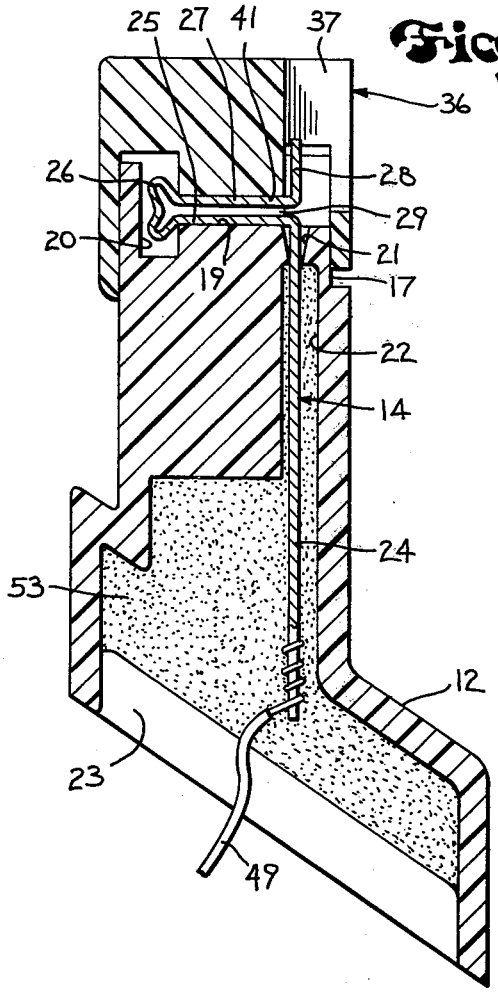
Fig. 5
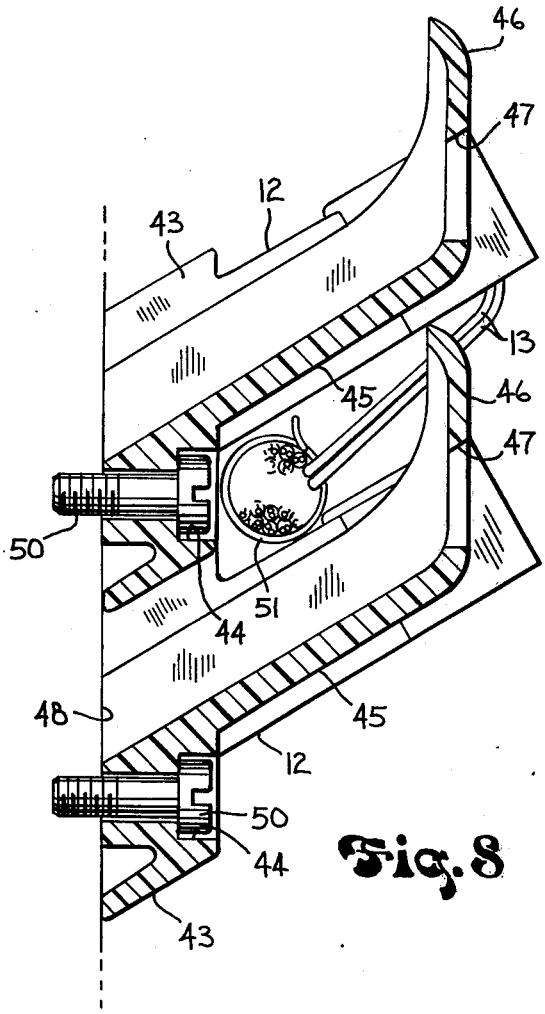
Fig. 8
Fig. 6
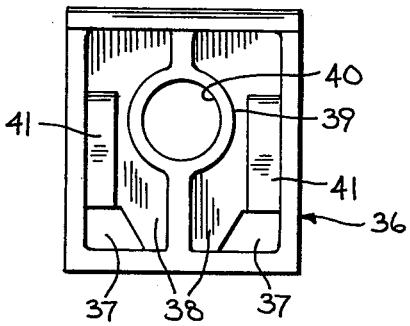
Fig. 7
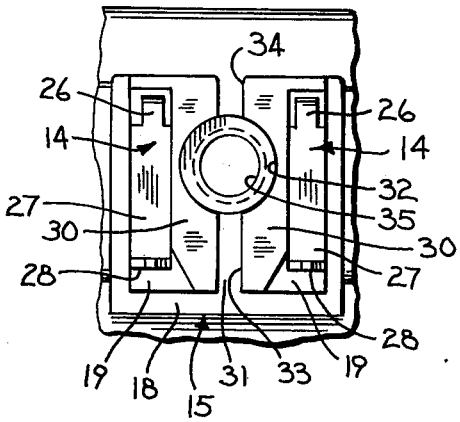

TERMINAL MODULE WITH DUAL BINDING POST TERMINALS

BACKGROUND OF THE INVENTION

The invention relates to electrical connectors used in mass termination arrays, and more particularly to wire terminal connectors employed in utility interface equipment.

To provide an efficient telephone distribution system between a central telephone equipment office and individual subscribers, primary distribution cables, called "feeder" cables, with as many as three thousand wire pairs must be connected to secondary distribution cables typically three hundred to nine hundred wire pairs apiece, usually at a location remote from the central office. This requires equipment with a capability for terminating and interconnecting a large number of wires.

In general, large numbers of wire connections are made to cross-connecting terminal blocks and wiring panels. In these devices, wires from feeder cables and secondary distribution cables are terminated on one side of the terminal block or panel, and cross-connections between the cables are made with jumper wires on the opposite side of the terminal block or panel.

In A. J. Humphries, U.S. Pat. No. 2,450,001, a cross-connection strip is shown, in which a pair of wires may be connected to a terminal, according to the specification, "through the medium of a single screw." The screw in Humphries' cross-connection strip has a point contact against a pressure block. The wires are each inserted between the pressure block of insulating material and a contact plate. Each terminal, including a pressure block and two contact plates is housed in a terminal block of honeycomb configuration. Substantial improvements over this type of cross-connection strip in the arrangement of screw fasteners, the design and operation of contacts, assembly requirements, and adaptability to mass termination and testing equipment, can be realized in a terminal module with binding post terminals.

Binding post terminals, which have been used in many other fields, have sometimes been used in cross-connect interface equipment. A wire can be secured in such a terminal by advancing a screw with an ordinary screwdriver. The binding posts of the prior art have been used most commonly to connect wires within a single circuit, whether one or more wires have been connected. See, for example, Christiansen, U.S. Pat. No. 3,555,495; Chryst, U.S. Pat. No. 1,193,513; and Munsie, U.S. Pat. No. 426,204. In telephone equipment it is necessary that wires be connected in pairs to other pairs of wires, Therefore, where it has been desired to use a binding post terminal in telephone interface or cross-connect equipment, wires have been connected in two ways. Two binding posts have been used to separately connect each wire in a pair. Or, a pair of contact points have been arranged coaxially on axially extending threaded members. With either of these constructions, the bare ends of the wires must be wrapped around the shaft of the screw or carefully held against a contact point until secured. This slows the basic jumping installation operation which is repeated thousands of times in cross-connecting or interfacing applications.

SUMMARY OF THE INVENTION

The invention includes an electrical connector that is assembled on a boss of insulating material with spaced apart terminal seats formed thereon. A pair of contact pins each extends through a respective terminal seat into the interior of the boss and includes a two-pronged wire clamp, with a lower prong disposed on the terminal seat, and an upper prong spaced apart from the lower prong to define a wire-receiving slot having an opening at one end of the wire clamp, at least one of the prongs being movable relative to the other. A cap of insulating material has spaced apart abutments each adapted to be seated on an upper prong of a respective wire clamp. A headed fastener is adapted to urge the cap toward the boss to close the wire clamps upon a pair of conductors inserted in the wire-receiving slots.

Preferably the cap fits over and around the end of the boss and is provided with a pair of recesses each opening into a wire-receiving slot.

The invention is embodied in a terminal module to which a plurality of wire pairs can be quickly connected. Each terminal in the module has a pair of electrically isolated, spring-hinged clamping contacts, each with a wire-receiving slot. The clamping contacts are captured between and isolated from one another by a boss and a cap, which are both made of insulating material, and which are fastened together to form an isolated pocket for each wire clamp. The cap is tightened down on the boss with a clamping screw theat engages a socket in the boss and has a head which urges the cap towards the boss. Such terminals allow an installer to insert a pair of wires into a corresponding pair of wire-receiving slots with one hand, and secure the wires by turning the screw with a screwdriver held in the other hand. Wires of sufficient diameter and rigidity will become wedged between the prongs of the clamping contacts when inserted, thereby further aiding installation. The boss, cap and wire clamp cooperate to form a funnel which guides the ends of wire into the wire receiving slots. The terminals are arranged in the module so that the screw head and the wire-receiving slots will be at a convenient angle to the module-mounting surface, thus providing good accessibility to the terminals when arranged in densely packed arrays.

It is the general object of the invention to make the installation and operation of utility interface equipment faster and easier by providing a modular dual terminal unit that simplifies the installation of a wire pair.

It is another general object of the invention to provide a wire terminal connector adaptable to high density arrangements.

It is a more specific object of the invention to provide a dual terminal unit to which a wire pair can be easily and securely connected by tightening a single fastener.

It is another specific object of the invention to provide a pair of wire-receiving slots in each dual terminal into which the spread apart ends of a wire pair can be easily inserted and held while the fastener is tightened.

It is another specific object of the invention to provide a clamping screw arrangement for each terminal in which the screw fastens the cap and the boss together, in place of the screw-pressure block arrangement of the prior art.

It is another specific object of the invention to provide terminals with electrical contacts in which a conductor can be wedged and held by the force of a spring which is a part of the contact.

It is another specific object of the invention to provide each assembled terminal with a pair of contact points that can be easily reached with a test probe.

It is another specific object of the invention to provide such a terminal with a minimum of component parts to facilitate manufacture and assembly.

It is another specific object of the invention to provide a dual terminal that is easily adapted to construction in modules which are integrally formed into larger, multiple units.

It is another specific object of the invention to provide dual terminals, which when mounted collectively in a mass termination array, are easily accessible for connecting and disconnecting wires.

It is another specific object of the invention to form the terminals in modules which can be nested to provide support and protection for bundled wire pairs connected to the terminals.

It is another specific object of the invention to provide a mass termination array of dual terminals which promotes tidiness in jumpering and wire running.

It is another specific object of the invention to provide a dual terminal unit for a wire pair which contains, within a minimum volume, an extensive arc path between the connections.

It is another specific object of the invention to provide a module including a plurality of dual terminals in which the connections are aligned linearly and in a single plane for ease of manufacture, assembly and installation.

The foregoing and other objects and advantages of the invention will appear from the following description. In the description reference is made to the accompanying drawings which form a part hereof, and in which a preferred embodiment of the invention is shown. The preferred embodiment does not necessarily represent the full scope of the invention, however, and reference should be made to the claims herein for interpreting the scope of the invention.

BRIEF DESCRIPTION OF THE DRAWINGS

FIG. 5 is a sectional view taken in the plane indicated by line 5—5 in FIG. 3;

FIG. 6 is a bottom view of the cap of the terminal shown in FIG. 2;

FIG. 7 is a top view of the boss of the terminal shown in FIG. 2; and

FIG. 8 is a sectional view of a pair of terminal modules like that of FIG. 1, which have been mounted on a vertical supporting surface.

DESCRIPTION OF THE PREFERRED EMBODIMENT

Figure 1:
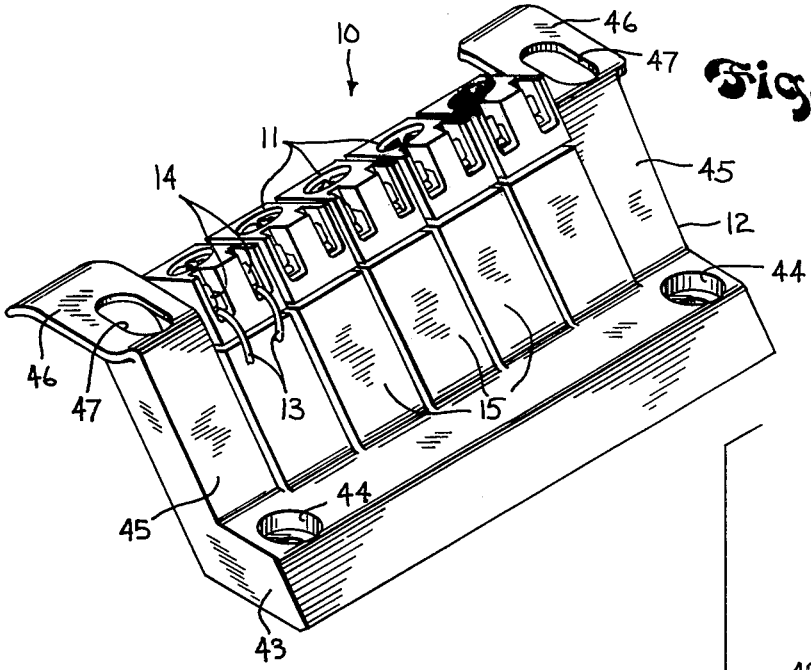
FIG. 1 is a perspective view of a terminal module that embodies the present invention.

Referring to FIG. 1, a terminal module 10 that embodies the present invention is formed from a plurality of dual binding post terminal units 11 which simplify the installation of utility interface equipment. The terminals 11 are mounted on a module housing 12 of resinous insulating material molded in a complex shape. As illustrated for one of the terminals in FIG. 1, a pair of wires 13 can be connected across a pair of electrically isolated contacts 14 to maintain two parallel branches in a circuit loop. The present invention can be best explained by beginning with a description of an individual terminal unit 11.

Figure 2:
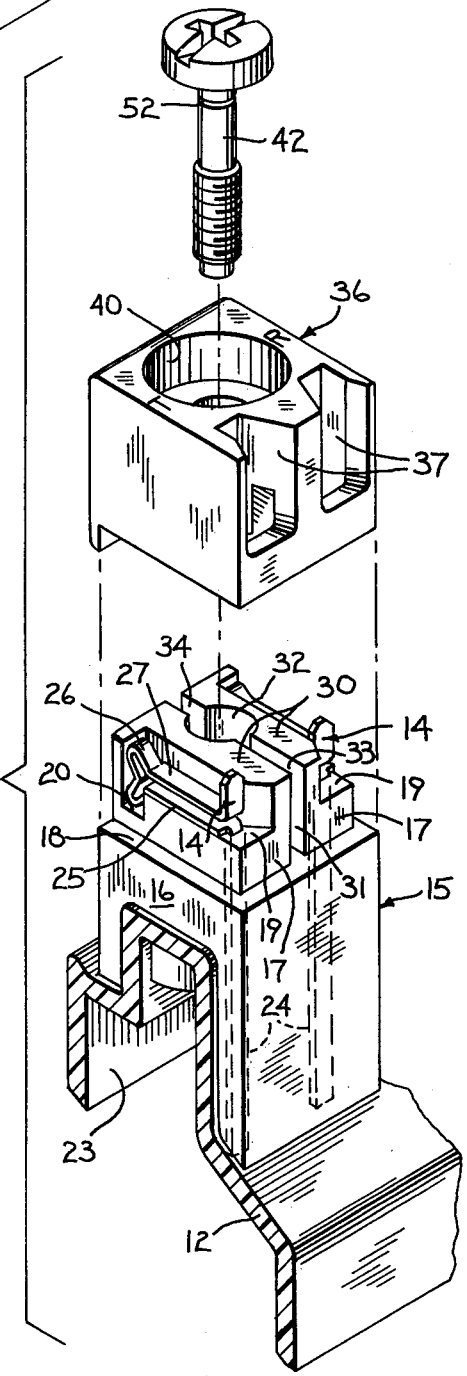
FIG. 2 is a partially exploded perspective view of a modular terminal unit of the present invention which has been broken out from the module of FIG. 1, and shown in an upright position.

In FIG. 2, a terminal 11 is shown with a supporting section of the housing 12 cut apart from the module 10. As seen in FIG. 2, the housing 12 is a hollow shell that rises from its bottom edges to form a horizontal ridge extending longitudinally between its ends. Upon this ridge a boss 15 is formed with a rectangular pedestal 16 and a neck portion split into two spaced apart mounting blocks 17 of complex shape rising from the pedestal. The mounting blocks 17 extend flush with the back edge of the pedestal 16 but terminate short of the respective sides and front of the pedestal 16 to form a narrow rim 18. Each mounting block 17 has a recess in which a ledge 19 extends along an outside edge of the block 17 above the level of the rim 18 and parallel to a respective side of the pedestal 16 to form a terminal seat. The ledges 19 extend from the front of each mounting block 17 towards the back, and are each separated from a back wall by a niche 20 extending downward from the ledge 19 towards the pedestal 16. Near the front edge of each ledge 19 a slit 21 pierces the boss 15, as seen in FIG. 5, and communicates with a channel 22 that is formed in a front wall of the housing 12. The channels 22 are spaced apart along the front wall of the housing 12 and extend downward, opening into a cavity 23 formed in the bottom of the housing 12.

Contact pins 14 of a shape which is seen best in FIG. 5 are seated on the mounting blocks 17. Each contact pin 14 is a continuous bent metal strip with a shank 24 that extends through a slit 21 and a channel 22 into the cavity 23. Each contact pin 14 is bent at a right angle to the shank 24 to form a lower prong 25 of a two-pronged wire clamp. The lower prong 25 extends rearward along the ledge 19 on which the contact in 14 is seated to an integrally formed kidney-shaped, bulbous hinge 26 that hangs over the back edge of the ledge 19 into the niche 20. An upper prong 27 of the wire clamp extends forward from the hinge 26 to the proximity of the shank 24. The end or tip 28 of the upper prong 27 is bent upward at a right angle to form a wire guide into a wire-receiving slot 29 between the prongs 25, 27. The tip 28 also forms a convenient contact point for a test probe. With the prongs 25, 27 of the wire clamp spaced apart a short distance relative to their length, the hinge 26 becomes a spring which flexes when the prongs 25, 27 are spread apart or pressed together from their normal position, and which returns the upper prongs 26 to their original spaced apart position when the urging force is removed.

Figure 4:
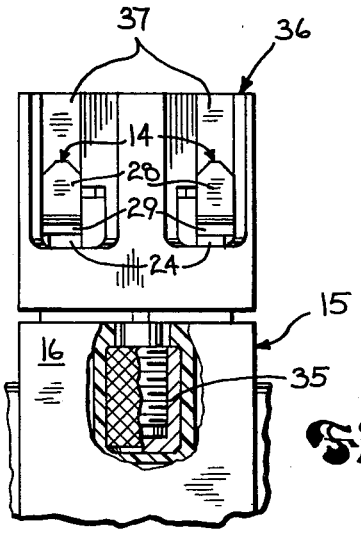
FIG. 4 is a front view of the terminal of FIG. 2 with a portion of the terminal boss broken away to show details in the interior of the boss.

Referring now to FIG. 2, the contact pins 14 can be quickly mounted on the boss 15 by inserting the shanks 24 through the perforated ledges 19 on the opposite sides of the boss 15. The mounting blocks 17 have curbs 30 rising from the inside edges of the ledges 19 to form insulating barriers between the seated contact pins 14. A key slot 31 separates the mounting blocks 17 between their respective curbed portions. As seen best in FIG. 7, the key slot 31 includes an annular passageway 32 with grooves 33, 34 of different lengths leading from the passageway 32 to the front and the back of the mounting blocks 17 respectively. The passageway 32 extends axially into the boss 15 to a socket formed in the pedestal 16 as shown in FIG. 4. The socket is formed by a metal insert 35, preferably of brass, with a threaded inner surface formed in an aperture and a knurled outer surface. The insulating material of the boss 15 is molded around the outside of the insert 35 and grips the knurled surface to hold the insert 35 in place.

Figure 3:
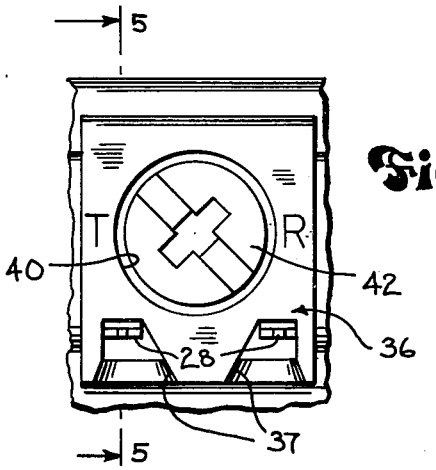
FIG. 3 is a top view of the terminal of FIG. 2.

Referring now to FIGS. 2–5, a cap 36, which is also made of a resinous insulating material molded in a complex shape, has two solid side walls and a solid back wall with a depending flange that hangs below the side walls. A pair of recesses 37 in a front wall of the cap 36 lead into the interior, forming chamfered surfaces that extend inwardly from the face of the cap 36. The recesses 37 become narrower as they extend inwardly into the cap 36 as shown in FIG. 3. Openings at the back of the recesses 37 lead into two compartments 38 within the cap 36, which are shown in FIG. 6. The compartments 38 are formed by the top and side walls of the cap 36 and by a flange 39 depending from the top wall of the cap 36 and extending from the front wall to the back wall to divide the compartments 38. The flange 39 includes a circular portion that encloses a screw-receiving aperture 40 and a pair of ribbed extensions that connect the circular portion to the front and back walls, respectively. In each compartment an abutment 41 is formed on the inside surface of the side wall which encloses a part of the compartment 38. The abutments 41 are spaced apart the same distance as the ledges 19 on the mounting blocks 17.

The cap 31 of FIG. 6 is slidably seated on the boss 15 of FIG. 7, with the circular portion of the flange 39 telescoping into the annular passageway 32 in the key slot 31. The ribbed extensions, which are of different lengths, fit into the grooves 33, 34 of the key slot 29, which are of corresponding lengths, so that the cap 36 is properly positioned relative to the boss 15. The curbs 30 and flange 39 form a labyrinth between the contact pins 14 so that an extensive air path must be ionized for an arc to bridge the pins 14. This extensive air path is provided in a minimum volume and yields high electrical performance.

The walls of the cap 36 generally enclose the neck portion of the boss 15 and the contact pins 14. As seen in FIG. 5, the cap 36 is seated with its abutments 41 on the upper prongs 27 of the contact pins 14. In order to move against the wire clamps, the cap 36 requires some clearance from the rim 18 of the pedestal 16 as shown in FIG. 4. The prongs 25, 27 of each contact pin 14 extend into the recesses 37 of the cap 36. There the upper prong tips 28 and the shanks 24 diverge in opposite directions, thereby locating the entrances to the wire-receiving slots 29 in the recesses 37.

The assembly of a terminal unit 11 is completed by inserting a terminal screw 42 through the screw-receiving aperture 40 in the cap 36 into the socket insert 35 in the boss 15, and advancing the screw 42. Preferably, the terminal screw 42 is a cross-slotted Phillips head screw of stainless steel. The screw-receiving aperture 40 is counterbored to receive the head of the screw 42. The termina screw 42 is provided with an annular groove 52 in its shank beneath its head. The game 52 will function as a plane of failure if the terminal screw 42 is tightened to a degree which, if not prevented, would result in damage to the pins 14 or conductors inserted between the prongs 25, 27. Thus, the terminal screw 42 functions as torque limiter which will cause the head of the screw 42 to break away if overloaded. After the breaking of the screw 42, the cap 36 can be removed because the screw head no longer interferes, and the threaded shank of the screw 42 can be grasped and removed.

A wire pair is inserted by an installer into an individual terminal unit 11 as shown in FIG. 1, by holding the stripped ends of the wires 13 in a spread apart position in one hand. The wires 13 are each directed towards a respective wire-receiving slot 29 in a recess 37 of the terminal cap 36. The pair of wires can be inserted from the open top of the recesses 37 and the tapered edges in the recesses 37, the tapered ends of the curbs 30 and the converging ends of the prongs 25, 27 will cooperate to guide or funnel the wires 13 into the two respective wire-receiving slots 29. The wires 13 may tend to push the prongs 25, 27 in each wire clamp apart. Because the lower prongs 25 are anchored by the shanks 24 in the terminal seats, this pushing apart is observed in the upward movement of the upper prongs 27. The wires 13 become wedged between the prongs 25, 27 of the wire clamps due to the resilient action of the spring hing 26. This is a desirable feature, because it allows the wires 13 to be released by the installer, if necessary, after insertion and before the clamping screw 42 has been tightened, without causing the wires 13 to pull out of the wire-receiving slots 29. This feature is, however, dependent upon the size and rigidity of the wires which are terminated.

The use of upper and lower prongs 25, 27 promote greatly improved electrical contact with the wires 13. The two prongs also spread the force on the wire so that localized loading which could sever the wire is eliminated.

Referring now to FIG. 1, a plurality of terminal units 11 are assembled in a module 10 by forming a module housing 12 with a plurality of bosses 15 of the type described above. A pir of contact pins 14 are inserted in each of the bosses 15 and a cap 36 is fastened to each boss 15 with a terminal screw 42 as described above. For purposes of illustration, only five terminals 11 are included in the module 10 of FIG. 1, however, modules with 25, 50 or 100 terminals can be used in forming mass termination arrays. The housing 12 rises at an angle from a plane normal to a laterally extending foot 43, which has a pair of counterbored mounting apertures 44 in its front corners. A pairs of end posts 45 are formed on the housing 12 at opposite ends of the terminal row and extend in a common plane with the terminal bosses 15 at an angle from perpendicular to the bottom of the housing 12. An angle of thirty degrees is optimum. The end posts 45 each have a flange 46 which is formed approximately parallel to the bottom of the housing 12 and which extends rearward of the terminals 11. The end post flanges 46 have apertures 47, which are each aligned with a mounting screw aperture 44 in front of its end post 45.

A plurality of modules 10 can be mounted to a vertical supporting surface 48 as shown in FIG. 8. The odules are disposed parallel to each other and nested with a toe of the foot 43 of one module housing 12 abutting the heel of the foot 43 of a module housing 12 mounted below it. The foot 43 of each housing 12 maintains proper spacing between its terminal units 11 and the terminal units 11 of adjacent modules 10. The modules 10 are mounted with mounting screws 50, which fit through the apertures 44 in the foot 43 of the housing 12. The modules 10 are mounted so that the terminals 11 extend upward and away from the supporting surface 48 at an angle of thirty degrees above the horizontal. After a group of modules 10 have been mounted, a single module 10 can be removed from the array, by removing its mounting screws 50 with a screwdriver inserted through the apertures 47 in the end flanges 46 of the module 10 in front of, or below, the module 10 to be removed.

The angular disposition of the terminal units 11 provides good access to both the terminal screws 42 and the wire-receiving slots 29, not shown in FIG. 8. This aids the connection and disconnection of wires 13 when the modules 10 are arranged in a closely packed array. The angular disposition can be varied from fifteen to forty-five degrees from perpendicular to the mounting surface 48, but best results are obtained with an angle of thirty degrees from perpendicular to the mounting surface 48. The angular position of the bosses 15, and the position of the end flanges 46, assist in the retention of a wire bundle 51 that is supported on the module 10 as shown in FIG. 8, and forces the installer to run the bundle of wires 13 in the trough defined between adjacent modules 10 thereby contributing to a tidy installation.

The wires 13 in the bundle 51 are connected to the wire clamping portions of the contact pins 14 in a plurality of terminal units 11 in repetitive operations of the type described previously for connection of a wire pair to a single terminal unit 11. The installation of the wires in a mass array of modules 10 is aided by the arrangement of each of the wire-receiving slots 29 in a single plane and along a common line. The arrangement of the terminal screws 42 in a line within one plane likewise eases the installation of wires 13, and both contribute to the tidiness of the resulting jumpering and cross-connections.

The shanks 24 of the contact pins 14 are connected to wires 49 as shown in FIG. 5. The wires 49 may be jumper wires or wires in a cable or bundle to be terminated on the bottom side of the module 10. A connection is made by wrapping a wire 49 around the shank 24 and soldering the wire 49 to the shank 24. These connections are made during the initial installation and are less subject to change than connections to the wire clamps, which are readily changed to achieve the necessary circuit connections. A major portion of the cavity 23, including the channels 22 is filled with potting compound 52 to assist in mechanically securing the shanks 24 of the contact pins 14 and to protect the connection of the wire 49 to the shank 24.

Thus, the invention provides an improved binding post terminal with dual connections for terminating a wire pair, and a module containing one or more such terminals. In each terminal the wire clamps are covered, insulated and protected by the cap. The terminals have easily accessible, linear wire-receiving slots that open into recesses in a front face of the cap to provide the necessary access to the two electrical circuits in each terminal. The wire clamps are physically and electrically isolated from each other by the central mating portions of the boss and the cap. The shank portions of the contact pins are physically and electrically isolated within their respective channels in the housing. Wires can be held in the wire-receiving slots with one hand while the clamping screw on top of the terminal is tightened with an ordinary screwdriver held in the other hand. When inserted into the wire-receiving slots, wires of sufficient size and rigidity will become wedged between the prongs of the wire clamps due to the action of the yieldable hinge joining the prongs of each wire clamp. The terminals have a minimum of component parts which fit together quickly and easily during assembly. The modules can be nested together to form densely packed arrays while maintaining the quick connection feature of the terminals.

We claim:

1. An electrical connector, which comprises:

a boss of insulating material with a pair of spaced apart terminal seats formed thereon;

a pair of contact pins each extending through a respective terminal seat into the interior of the boss and including a two-pronged wire clamp, with a lower prong disposed on the terminal seat, and an upper prong spaced apart from the lower prong to define a wire-receiving slot having an opening at one end of the wire clamp, at least one of the prongs being movable relative to the other;

a cap of insulating material fitting over and around the end of the boss, and including a pair of recesses each opening into a respective wire-receiving slot and a pair of spaced apart abutments each adapted to be seated on an upper prong of a respective wire clamp; and a headed fastener adapted to urge the cap towards the boss to close the wire clamps upon a pair of conductors inserted in the wire-receiving slots.

2. The electrical connector of claim 1, wherein the contact pins are continuous strips of conductive material.

3. The electrical connector of claim 1, wherein the upper prongs of the wire clamps each have an angularly turned tip disposed within a respective recess to guide a wire into the wire-receiving slot commencing in the recess, and wherein said tips are accessible to the exterior through said recesses in said cap.

4. The electrical connector of claim 1, wherein the wire clamps each include a resilient hinge that joins the prongs at one end of the wire clamp.

5. The electrical connector of claim 4, wherein the wire clamp hinge is integrally formed with the prongs and bulbous.

6. In a terminal module having a housing of insulating material, the combination comprising;

a boss of insulating material formed on the housing and having a pair of recesses formed in opposite sides, a pair of terminal seats each formed in a respective recess, and a pair of spaced apart channels each depending from a respective terminal seat into the interior of the housing;

a pair of contact strips each having a portion disposed on a respective recessed terminal seat, and another portion extending through the terminal seat into the channel below;

a cap of insulating material including a hollow interior in which the terminal seats and the portions of the contact strips disposed thereon are received and housed, spaced apart openings each adapted for access to a respective terminal seat, and spaced apart abutments formed in the interior of the cap, each abutment opposing a respective terminal seat and the contact strip disposed thereon; and a clamping screw fastening the cap to the boss and operable for advancement to secure electrical contact between the contact strips, which are in physical and electrical isolation from each other, and a pair of conductors, each inserted through a respective opening in the cap to a position between a terminal seat and its opposing abutment.

7. The combination of claim 6, wherein the boss includes an axially extending key slot formed between the terminal seats; and wherein the cap includes a depending circular flange with ribbed extensions, the flange together with its extensions fitting slidably within the key slot.

8. The combination of claim 6, wherein the boss includes a socket for the clamping screw with a metal thread-engaging liner around which the boss is molded.

9. A terminal module for connecting two groups of wire pairs in a mass termination array, comprising:

a housing of insulating material having a cavity adapted to receive the wire pairs in the first group, and a plurality of spaced bosses formed side by side in a longitudinal row, each boss having a pair of spaced apart terminal seats formed thereon;

a plurality of pairs of contact pins, each pin having a shank, that extends through a respective terminal seat into the housing cavity and is adapted for connection to a wire in the first group, and a two-pronged wire clamp that extends from the shank, with a lower prong disposed on the terminal seat and a yieldable upper prong spaced from the lower prong to form a wire-receiving slot;

a plurality of caps of insulating material, each slidably seated on a respective boss with spaced apart abutments each seated on an upper prong of a respective wire clamp; and a plurality of clamping screws each fastening a respective cap to a respective boss and each operable for advancement to close the wire clamps upon a pair of wires from the second group which are held in the wire-receiving slots.

10. The terminal module of claim 9, wherein the bosses extend at an angle from perpendicular to a plane defined by the bottom edges of the module housing to provide accessibility to the terminals when the modules are mounted in a termination array.

11. A terminal module for connecting a bundle of wire pairs, comprising:

a housing of insulating material including a foot having a plurality of spaced mounting apertures, a plurality of spaced bosses rising side by side from the foot to form a row, a pair of end posts rising from the foot on opposite ends of the row of bosses, each end post rising behind a respective mounting aperture, a pair of flanges each extending rearward from a respective end post and having an aperture which is aligned with the mounting aperture in front of the end post;

a plurality of pairs of electrical contacts, each pair of contacts being seated on a respective boss and spaced apart for physical and electrical isolation from one another;

a plurality of caps of insulating material each slidably seated on a respective boss and including spaced apart abutments each opposing a respective seated contact and adapted for cooperation with the boss to secure the contact to a wire inserted between the abutment and the boss; and a plurality of clamping screws each fastening a respective cap to a corresponding boss to form a terminal unit and each operable for advancement to secure a wire pair having each wire inserted between a respective abutment and the boss;

whereby the module flanges overhang the foot of an identical, coextending and abutting module positioned along the back side of the housing and retain a bundle of wire pairs disposed between the housings of the two modules while permitting access to the mounting apertures of the abutting module.

12. An electrical connector, which comprises:

a boss of insulating material with a pair of spaced apart terminal seats formed thereon;

a pair of contact pins each extending through a respective terminal seat into the interior of the boss and including a two-pronged wire clamp, with a lower prong disposed on the terminal seat, and an upper prong spaced apart from the lower prong to define a wire-receiving slot having an opening at one end of the wire clamp, at least one of the prongs being movable relative to the other;

a cap of insulating material having spaced apart abutments each adapted to be seated on an upper prong of a respective wire clamp; and a headed fastener adapted to urge the cap towards the boss to close the wire clamps upon a pair of conductors inserted in the wire-receiving slots.

13. The combination of claim 12, wherein said boss includes an axially extending slot formed between the terminal seats; and wherein said cap includes a depending rib which is received in and mates with said slots to orient said cap relative to said boss.

14. The combination of claim 12 wherein said fastener is a bolt having a point of reduced cross section along its shank and adjacent its head, said bolt being adapted to break at said point when subjected to torque loads beyond a preselective level.

* * * * *